US005544253A

United States Patent [19]

Nagayoshi et al.

[11] Patent Number: 5,544,253

[45] Date of Patent: Aug. 6, 1996

[54] EARPHONE ASSEMBLY

[75] Inventors: Atsushi Nagayoshi, Katano; Kazunori Kono, Hirakata, both of Japan

[73] Assignee: Matsushita Electric Industrial Co., Ltd., Osaka, Japan

[21] Appl. No.: 286,259

[22] Filed: Aug. 8, 1994

[30] Foreign Application Priority Data

Aug. 6, 1993 [JP] Japan ..... 5-195878

[51] Int. Cl.[6] ..... H04R 25/00

[52] U.S. Cl. ..... 381/187; 381/183; 379/430

[58] Field of Search ..... 381/183, 187, 381/25, 68.6, 154; 379/430; 181/129, 130, 135, 128

[56] References Cited

U.S. PATENT DOCUMENTS

| | | | |
|---|---|---|---|
| 1,893,143 | 1/1933 | Koch | 181/135 |
| 3,983,336 | 9/1976 | Malek et al. | 381/69.2 |
| 4,403,120 | 9/1983 | Yoshimi . | |
| 4,634,816 | 1/1987 | O'Malley et al. | 381/183 |
| 4,736,435 | 4/1988 | Yokoyama et al. | 381/188 |
| 4,965,838 | 10/1990 | Kamon et al. . | |
| 4,972,492 | 11/1990 | Tanaka et al. . | |
| 5,222,151 | 6/1993 | Nagayoshi et al. . | |

FOREIGN PATENT DOCUMENTS

| | | |
|---|---|---|
| 0143383 | 6/1985 | European Pat. Off. . |
| 0373816 | 6/1990 | European Pat. Off. . |
| 0421681 | 4/1991 | European Pat. Off. . |
| 2220819 | 1/1990 | United Kingdom . |

OTHER PUBLICATIONS

Patent Abstracts of Japan, vol. 15, No. 46 (E–1029), Feb. 4, 1991.

*Primary Examiner*—Forester W. Isen
*Assistant Examiner*—Duc Nguyen
*Attorney, Agent, or Firm*—Wenderoth, Lind & Ponack

[57] ABSTRACT

In an earphone assembly, a front cap portion of an outer casing (5) having an electroacoustic transducing device (12) therein is made to have a substantially circular configuration being greater in diameter than other portions to be able to be fit in the cavity of the auricle. The earphone assembly has a cord supporting member (4) for a connection cord (3) of the electroacoustic transducing device (12) and a movable member (10) pivotable with respect to the outer casing (5). A protruded portion (2a) of the outer casing protrudes peripherally from a peripheral portion of the front cap member thereof. The protruded portion (11) of the movable member (10) cooperates with the peripheral portion of the front cap member of the outer casing (5) to allow the earphone to be fit in the cavity of the auricle (9).

20 Claims, 5 Drawing Sheets

EARPHONE ASSEMBLY

BACKGROUND OF THE INVENTION

1. Field of the Invention

The present invention relates to an earphone, and is more particularly directed to a compact earphone assembly having an electroacoustic transducer element for transducing an electric signal derived from an audio device into sound, the earphone being directly fit in an auricle of a person to allow the person to listen to the sound.

2. Description of the Prior Art

In recent years, there has been increasingly used a compact light-weight earphone to be fit in a cavity of an auricle instead of a type to be inserted into an external auditory meatus or of a headphone type provided with a headband. Furthermore, in company with the popularization of portable audio devices, there is a growing demand for making portable audio devices light in weight and improving their attachability.

The following describes an example of a conventional earphone with reference to FIGS. 6A and 6B.

FIG. 6A shows a schematic external view of the conventional earphone, while FIG. 6B shows a view of the conventional earphone when fit in the human auricle. In FIGS. 6A and 6B, a housing body 1 incorporates an electroacoustic transducer element, and a front cap member 2 covers the front surface of the electroacoustic transducer element. A connection cord 3 is guided through a cord supporting member 4 from the housing body 1 to the outside to supply electric power from an audio apparatus to the electroacoustic transducer element. An outer casing 5 is of a substantially elliptical shape, has a major diameter L1 and a minor diameter L2, and is generically comprised of the housing body 1 and the front cap member 2. Reference numerals 6, 7, 8, and 9 respectively denote the external auditory meatus, tragus, antitragus, and auricle of a person.

The peripheral portion of the front surface of the outer casing 5 has an oval configuration. The reason why the front surface has an oval configuration is that an outer diameter of 17.4 mm is required for internally storing the electroacoustic transducer element when a circular configuration is adopted for the front surface, which results in an increased pressure to be applied to users. Therefore, an oval shape is adopted in order for the front surface portion to have a minimized size. Such an earphone is fit in the cavity of the auricle 9 so that the earphone can be retained in the ear, with the consequence that the cord supporting member 4 is caught between the tragus 7 and the antitragus 8 and that the outer casing 5 is put in contact with both a portion of the tragus 7 on the side of the external auditory meatus 6 and the cavity of the auricle 9.

However, since the conventional earphone as described above has a fixed configuration (particularly the dimensions L1 and L2 shown in FIG. 6 A are fixed), there has been a problem in that the earphone tends to easily fall out when used by a person who has a large auricle, while the earphone gives excessive pain to or cannot be fit in the ear of a person who has a small auricle.

SUMMARY OF THE INVENTION

The present invention has been developed with a view to substantially solving the above described disadvantages, and has for its essential objective to provide an improved earphone which is capable of obtaining a more comfortable attachability by covering the individual difference in size of the auricle and preventing the earphone from easily falling out or giving pain to the ear.

In order to achieve the aforementioned objective, the present invention provides an earphone assembly to be fit in a human auricle which comprises a substantially circular shaped outer casing to be fit in a cavity of the auricle. The outer casing is comprised of a housing body and a front outer portion, and has an electroacoustic transducer element securely incorporated therein. A cord supporting member for supporting a connection cord extends from the electroacoustic transducer element to the outside.

A movable member of a generally annular shape is rotatable with respect to the outer circumference of the outer casing and has a protruded portion which protrudes outward from a part of a peripheral portion of the movable member. The protruded portion of the movable member cooperates with the peripheral portion of the front outer portion of the outer casing to allow the earphone to be fit in the cavity of the auricle.

The peripheral portion of the front outer portion of the outer casing is also provided with a protruded portion which protrudes outward from a part of a peripheral portion thereof.

The front outer portion of the outer casing is configured to be substantially circular, and is greater in diameter than other portions to be fit in a cavity of the auricle.

With the above-mentioned construction, the movable member is rotatable to be adjustable according to the individual difference of the size of the auricle in particular the size of the cavity of the auricle, to thereby change the size of the portion to be attached and fit in the cavity of the auricle. The above arrangement eliminates the tendency of the earphone to easily fall out when used by a person who has a large auricle or give pain to the ear of a person who has a small auricle.

BRIEF DESCRIPTION OF THE DRAWINGS

The above and other objects and features of the present invention will become clear from the following description taken in conjunction with the preferred embodiments thereof and with reference to the accompanying drawings, throughout which like parts are designated by like reference numerals, and in which.

DETAILED DESCRIPTION OF THE PREFERRED EMBODIMENTS

The following describes an embodiment of the present invention with reference to FIGS. 1 through 5.

Figure 1:
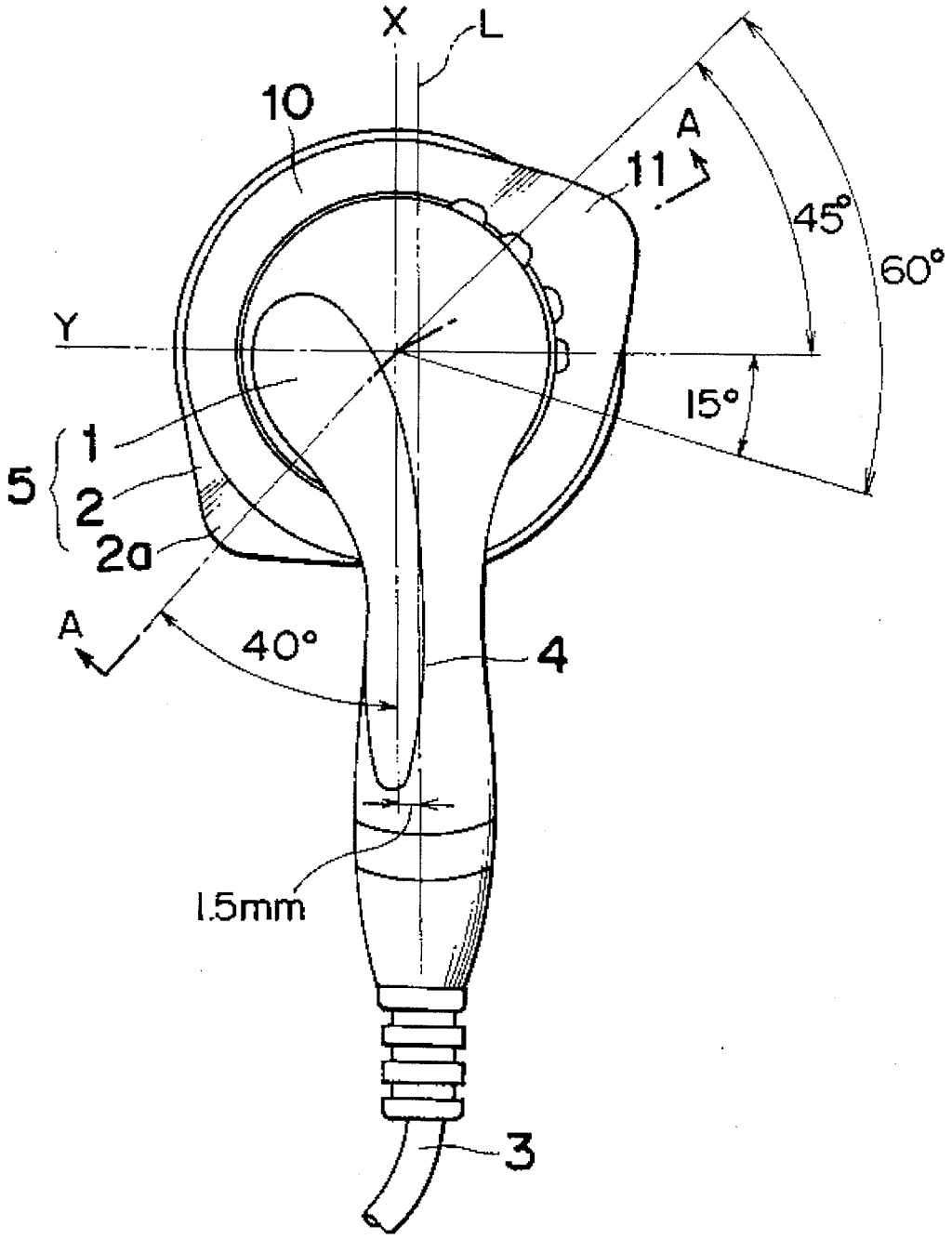
FIG. 1 is a schematic external view of an earphone in accordance with an embodiment of the present invention.

FIG. 1 shows an entire outline of an earphone for a left ear in accordance with an embodiment of the present invention. It is to be noted here that, since an earphone for the righthand ear is symmetrical to that for the lefthand ear, no description is provided therefor.

Figure 2:
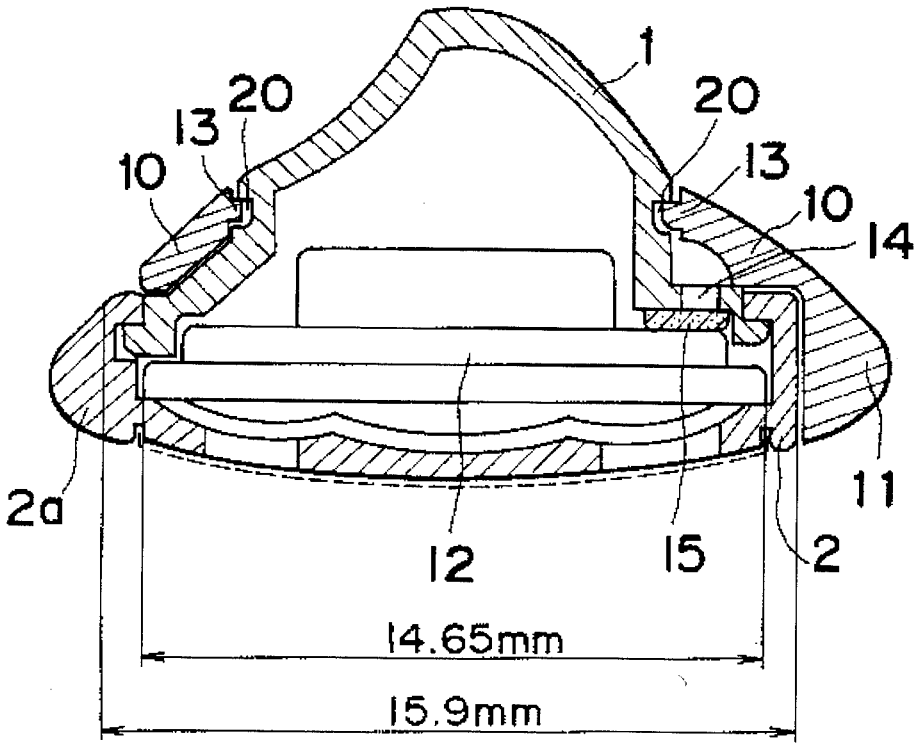
FIG. 2 is an approximately sectional view of the earphone taken along line A—A in FIG. 1.

In FIGS. 1 and 2, an outer casing 5 is comprised of a housing body 1 and a front cap member 2, where the housing body 1 serves as a case body for housing an electroacoustic transducer element 12 and the front cap member 2 is securely attached to the housing body 1 for covering and fixing the front surface of the electroacoustic transducer element. The front face of the front cap member 2 is covered with a protective net (not shown). The housing body 1 and the front cap member 2 have a substantially circular outer shape. A connection cord 3 is guided in the housing body 1 for supplying an electric power signal derived from an audio device (not shown) to the acoustic transducer. A cord supporting member 4 is integrally formed with the housing body 1 to guide the connection cord 3 extending from the auricle to an audio device.

A generally annular movable member 10 is further mounted on the housing body 1 and is rotatable within a specified range of angle (e.g., 60 degrees) around the circumference of the housing body 1. The movable member 10 has a protruded portion 11 protruding outward and frontward from a peripheral portion thereof, which the protruded portion 11 is formed integrally with the movable member 10. The front cap member 2 is formed in a substantially circumferential configuration and has a protruded portion 2*a* which protrudes outward in radial direction over a specified angle (e.g., 40 degrees) with respect to a vertical reference line X of the housing body 1 as shown in FIG. 1. The direction of the protruded portion 2*a* of the front cap member 2 is determined in angle so that the protruded portion 2*a* is positioned on the side of the external auditory meatus when the outer casing 5 of the earphone is fit in the cavity of the auricle 9.

In more detail, the front cap member 2 is fixed to the housing body 1 so that the protruded portion 2*a* thereof is positioned at a fixed angle with respect to the cord supporting member 4 so that the protruded portion 2*a* and the protruded portion 11 of the movable member 10 cooperate with each other to be fit in the auricle of a user, avoiding the imposition of excessive pressure to the user's ear when placed in the concha.

The cord supporting member 4 has an approximately cylindrical configuration, having its longitudinal center line L displaced rightward in position in the figure with respect to the vertical reference line X of the housing body 1 by a specified dimension of, e.g., 1.5 mm.

The movable member 10 is circumferentially rotatable around the periphery of the housing body 1 within a specified range in angle in such a manner that the protruded portion 11 is pivotable in a range between a specified clockwise angle (e.g., 15 degrees) and a specified counterclockwise angle (e.g., 45 degrees), i.e., total 60 degrees with respect to a horizontal reference line Y of the housing body 1. The protruded portion 11 of the movable member is movable in its pivotal range to include at least a position approximately opposite to the protruded portion 2*a* of the front cap member 2 of the outer casing.

Figure 4:
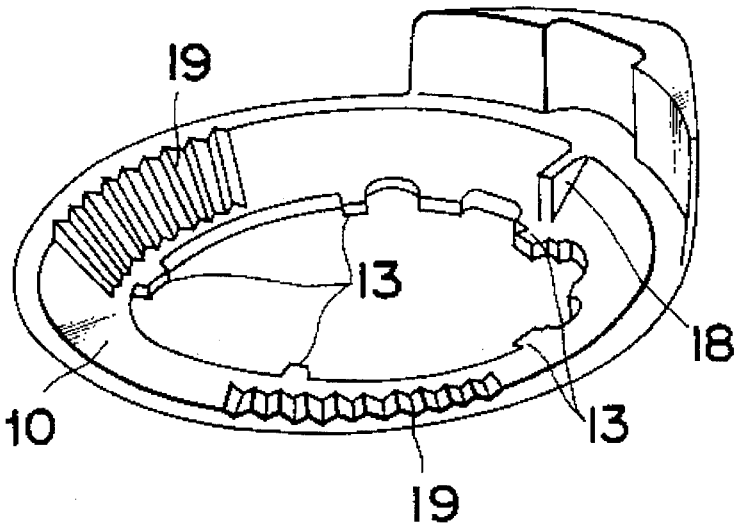
FIG. 4 is a perspective view of a movable member of the earphone according to the embodiment of the present invention viewed from a rear surface.

As shown in FIG. 4, a ratchet structure designated by reference numeral 16 and 19 is constructed on the inner surface of the movable member 10 so that the movable member 10 can be engaged with the housing body 1 in a ratchet manner at each interval of a specified angle (e.g., 7.5 degrees). That is, the movable member can be retained at each of nine positions within the rotatable range of, for example, 60 degrees.

The following describes in more detail the structure of the earphone assembly according to the embodiment of the present invention with reference to FIGS. 2 through 4.

In FIGS. 2 through 4, the movable member 10 is formed of polyacetal resin, and the protruded portion 11 is formed integrally with the movable member 10, having a plurality of ribs 13 formed integrally with the movable member 10. Each of the ribs have substantially the same configuration and inwardly protrude at, for example, five portions of the inner circumference of the movable member 10. The acoustic transducer 12 is securely incorporated within the housing body 1. A plurality of acoustic through holes 14 are formed in a peripheral flange portion of the housing body 1, while a damping cloth 15 made of e.g. urethane resin is provided under the peripheral flange portion of the housing body 1 covering the acoustic holes 14 for providing acoustic resistance.

Figure 3A:
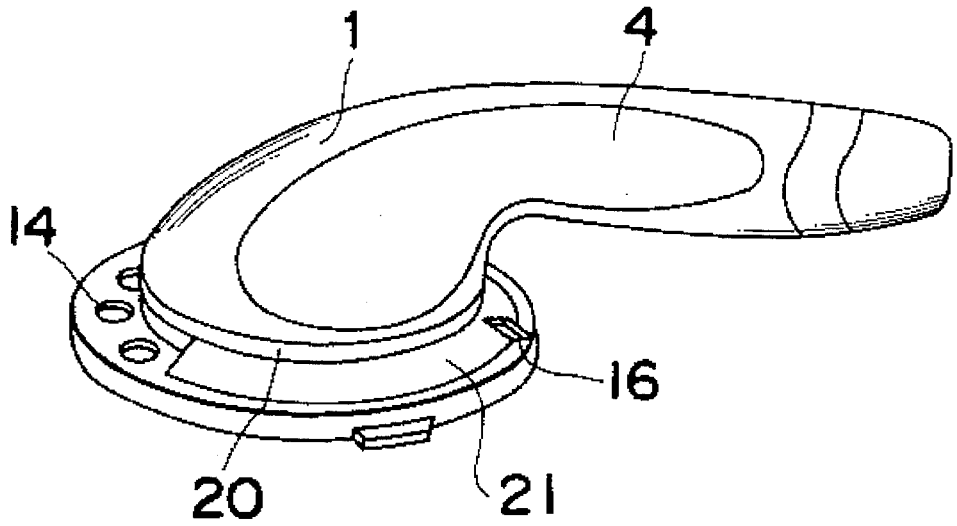
FIGS. 3A and 3B are perspective views of a housing body of the earphone for the left ear viewed in two directions according to the embodiment of the present invention.

As shown in FIGS. 3A and 4, a ratchet rib 16 is provided integrally with the housing body 1 and protrudes upward so as to be engaged with any one of a pair of knurl portions 19 made of polyacetal resin which are formed integrally with the inner surface of the movable member 10. The ratchet structure is constructed by the engagement between the ratchet rib 16 and the knurl portions 19. Each of the knurl portions 19 has nine roots which provides nine engagement positions. The reason why the movable member 10 is provided with a pair of symmetrical knurl portions 19 is that the movable member 10 is allowed to be commonly used as a member for both the lefthand and righthand ears.

Figure 3B:
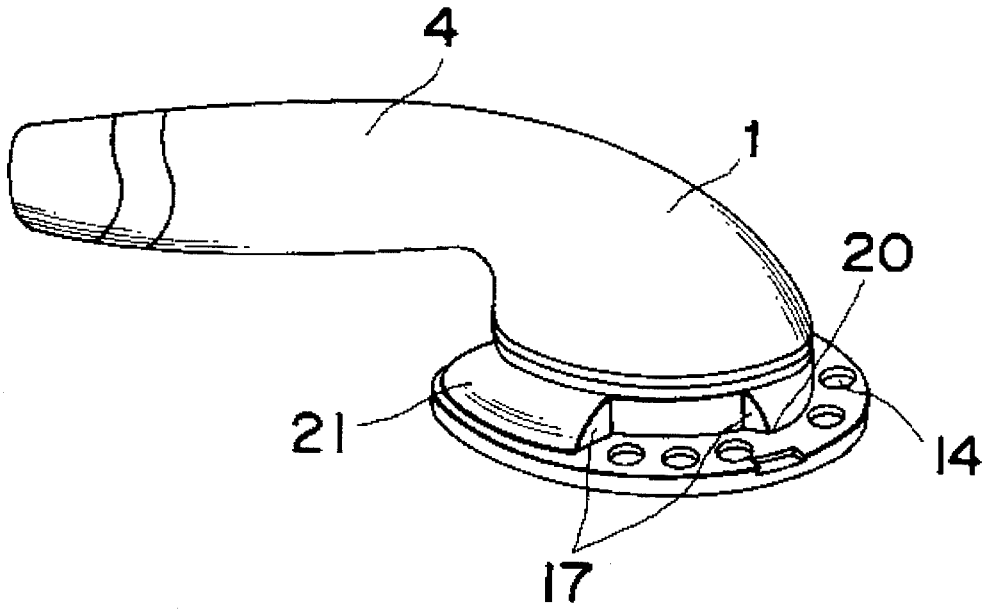

As shown in FIG. 3B, a pair of stopper receiving edge walls 17 are integrally defined in the peripheral flange portion (21) of the housing body 1, while a stopper rib 18 as shown in FIG. 4 is formed to integrally protruding inward from an inner surface of the movable member 10. The space defined between the stopper receiving edge walls 17 is formed to provide a minimum space for allowing the stopper rib 18 to be movable within a specified range of an angle of, for example, 60 degrees.

As shown in FIG. 2, the inner circumferential ribs 13 of the movable member 10 are engaged with an outer circumferential groove 20 which is formed around an outer circumferential surface of a rear wall portion of the housing body 1 so that the movable member 10 is retained to be rotatable around the circumferential periphery of the housing body 1 without disengagement. It should be noted here that the movable member 10 is engaged with the housing body 1 by snapping it in from behind the housing body 1.

The following describes the operation of the earphone assembly having the above-mentioned construction.

Figure 5A:
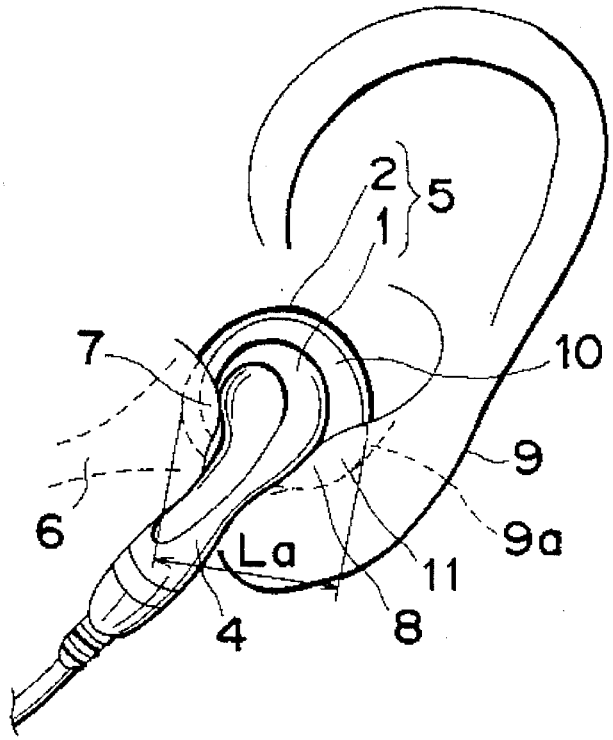
FIGS. 5A and 5B are plan views of the earphone of the present embodiment where the earphone is fit in the auricle.
Figure 5B:
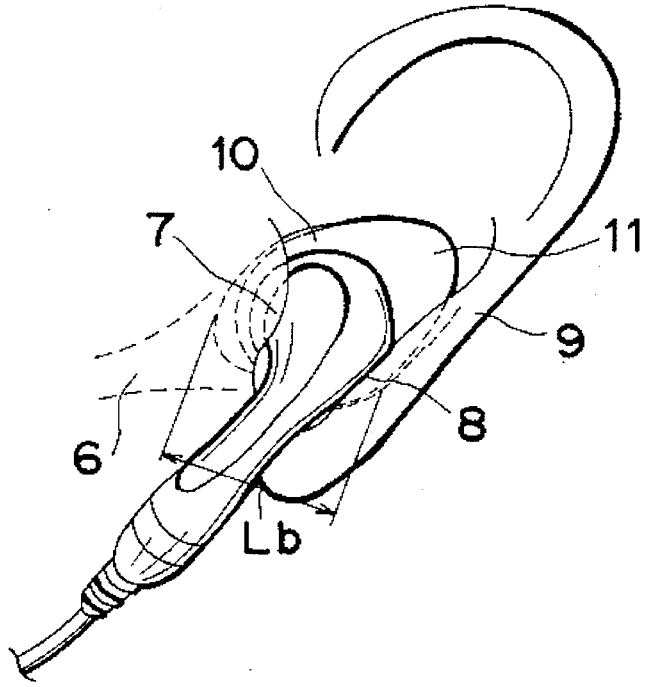

FIGS. 5A and 5B show conditions where the earphone of the present embodiment is fit into the auricle. FIG. 5A shows the case of a large human auricle, and FIG. 5B shows the case of a small human auricle.

In FIGS. 5A and 5B, reference numeral 6 denotes an external auditory meatus, 7 a tragus, 8 an antitragus, 9 an auricle, and 9*a* a concha cavity constituting the auricle cavity. FIG. 5A shows a condition where the protruded portion 11 is pivoted to the lowermost position, i.e., the clockwise end of the range of movable member 10, while FIG. 5B shows a condition where the protruded portion 11 is pivoted to the uppermost position, i.e., the counterclockwise end of the range of movable member 10.

In each case, either one or both of the peripheral portion of the front surface of the outer casing 5 and the movable member 10 are put in contact with the inner surface of the tragus 7 on the side of the external auditory meatus 6 and the concha cavity 9*a*, and at the same time the cord supporting member 4 is retained between the tragus 7 and the antitragus 8 to allow the earphone to be fit in the cavity of the auricle 9.

Particularly when the cavity of the auricle 9 is large, the earphone is prevented from falling out by positively abutting the protruded portion 11 against the concha cavity 9*a* as shown in FIG. 5A. When the cavity of the auricle 9 is small, a sense of oppression can be eliminated by putting the protruded portion 11 away from the concha cavity 9*a* as shown in FIG. 5B. In other words, by rotating the movable member 10, the size in diameter of the front peripheral portion (2*a*, 11) can be changed between the distances La and Lb as shown in FIGS. 5A and 5B so that the front peripheral portion is directly put in contact with the auricle 9 when fitting the earphone in the cavity of the auricle 9.

Figure 6A:
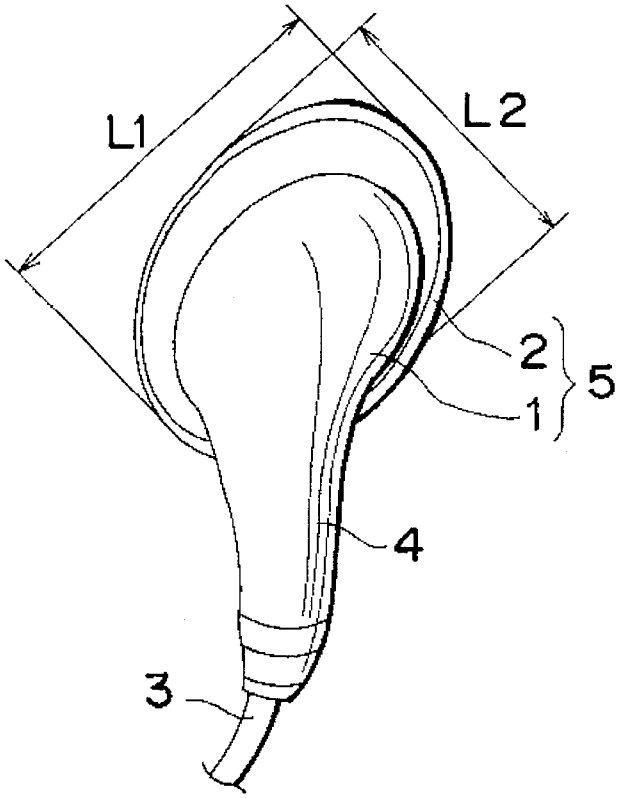
Fig. 6A PRIOR ART
FIGS. 6A and 6B are a schematic external view of a conventional earphone and a plan view thereof where the earphone is fit in the auricle.
Figure 6B:
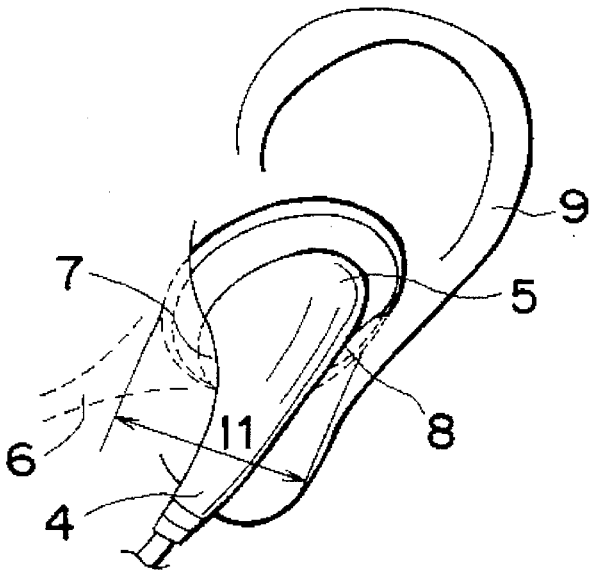
Fig. 6B PRIOR ART

In the present embodiment, the acoustic transducer element 12 having a diameter of 14.65 mm is employed, and the minimum diameter of the periphery of the front surface of the front cap member 2 is set to 15.9 mm. Therefore, the distance La is se to 18.2 mm, while the distance Lb is set to 15.9 mm. In the conventional case, since $l_1$ in FIG. 6B is 16.9 mm, a relation of La>$l_1$>Lb holds, and accordingly the present embodiment can cover a wider range of sizes of the auricle.

According to the present embodiment as described above, an optimum attachability of the earphone can be achieved by adjusting the rotation angle position of the movable member according to the size of the auricle to thereby prevent the earphone from easily falling out when used by a person who has a large auricle or from giving excessive pain to the ear of a person who has a small auricle.

According to the present invention as described above, a front portion of an outer casing is made to have a substantially circular configuration greater in diameter than other portions to be fit in a cavity of a human auricle. The earphone assembly is provided with a cord supporting member for supporting a connection cord extending to the electroacoustic transducer element which is fixedly built in the outer casing, where a movable member having an outward protruded portion is circumferentially rotatable with respect to the circumference of the housing body, while a part of a front cap portion of the outer casing is also protruded outward from a peripheral portion thereof. The protruded portion of the movable member cooperates with the peripheral portion of the front cap member to allow the earphone to be fit in the cavity of the auricle. The above arrangement provides an optimum attachability of the earphone by adjusting the rotational position of the movable member according to the size of the auricle, effectively preventing the earphone from easily falling out when used by a person who has a large auricle or from imposing an excessive pain to the ear of a person who has a small auricle.

Although the present invention has been fully described in connection with the preferred embodiment thereof and with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An earphone assembly to be fit in a human auricle, comprising:

an annular outer casing adapted to be fitted in a cavity of the auricle comprising a housing body and a front outer portion having a peripheral portion, said annular outer casing having an electroacoustic transducer element securely incorporated therein and an outer circumference;

a cord supporting member on said annular outer casing for supporting a connection cord extending from said electroacoustic transducer element to outside of said annular outer casing; and a movable member having an annular shape, said movable member being rotatably mounted with respect to the outer circumference of said annular outer casing and having a peripheral portion and a protruded portion protruding outwardly from a part of said peripheral portion of said movable member;

wherein said protruded portion of said movable member cooperates with said peripheral portion of said front outer portion of said annular outer casing to define a means for fitting and holding said earphone assembly in the cavity of the auricle.

2. The earphone assembly of claim 1, wherein said peripheral portion of said front outer portion of said annular outer casing has a circular configuration provided with a second protruded portion that protrudes outwardly from a part of said peripheral portion of said front outer portion.

3. The earphone assembly of claim 2, wherein said cord supporting member extends in a certain direction from said outer casing and said second protruded portion is positioned at a specified angle with respect to said certain direction.

4. The earphone assembly of claim 2, wherein said movable member and said protruded portion of said movable member are rotatable in a restricted angular pivotal range less than 360° on said outer casing, said angular pivotal range including a position of said protruded portion of said movable member that is opposite to said second protruded portion of said outer casing.

5. The earphone assembly of claim 4, wherein said angular pivotal range of said protruded portion of said movable member is defined relative to a reference line extending through a center point of said annular outer casing and perpendicular to a longitudinal center line of said cord supporting member, said angular pivotal range extending from a point displaced about 15 degrees from said reference line toward said cord supporting member to a point displaced about 45 degrees from said reference line away from said cord supporting member.

6. The earphone assembly of claim 4, wherein said housing body comprises a peripheral flange portion having a pair of spaced stopper receiving edge walls defining a cut-off portion therebetween, and said movable member further comprises an inner surface having a stopper rib integrally formed therewith that protrudes inwardly from said inner surface into said cut-off portion, whereby said spaced stopper receiving edge walls define said restricted angular pivoted range.

7. The earphone assembly of claim 2, wherein said second protruded portion protrudes outwardly in a radial direction of said outer casing at a specified angle relative to a reference line of said housing body such that said means for fitting and holding functions to position said second protruded portion on a side of said external auditory meatus when said outer casing is fitted in the cavity of the auricle.

8. The earphone assembly of claim 2, wherein said second protruded portion is positioned at a fixed angle relative to said cord supporting member such that said means for fitting and holding has said second protruded portion and said protruded portion of said movable member cooperate with each other in fitting and holding said earphone assembly in the auricle of a user.

9. The earphone assembly of claim 1, wherein said protruded portion of said movable member is integral with said movable member.

10. The earphone assembly of claim 1, wherein:

said cord supporting member has a tubular configuration with a longitudinal centerline;

said annular outer casing has a center; and said longitudinal centerline of said cord supporting member is offset with respect to said center of said outer annular casing.

11. The earphone assembly of claim 1, wherein said housing body comprises an outer surface and a ratchet rib integral with said housing body and protruding from said outer surface of said housing body, and said movable member further comprises an inner surface and a pair of symmetrical knurl portions integral with said movable member and formed on said inner surface of said movable member, one of said pair of symmetrical knurl portions being engaged with said ratchet rib, thereby forming a ratchet structure.

12. The earphone assembly of claim 11, wherein each one of said pair of knurl portions comprises nine roots defining nine engagement positions circumferentially spaced on said movable member, whereby said movable member can be retained at one of nine separate angular positions on said annular outer casing.

13. The earphone assembly of claim 11, wherein said movable member further comprises an inner circumference and a plurality of ribs formed integrally therewith and protruding at circumferentially spaced positions along said inner circumference.

14. The earphone assembly of claim 13, wherein said housing body comprises an outer circumferential wall portion having an outer circumferential groove, said ribs of said movable member being engaged with said groove.

15. An earphone assembly to be fit in a human auricle, comprising:

an annular outer casing comprising a housing body having an open side and a front outer portion on said housing body, said front outer portion comprising a front cap covering said open side of said housing body;

an electroacoustic transducer element secured in said annular outer casing adjacent to said front cap;

engaging means on said annular outer casing for adjustably engaging and supporting said annular outer casing in a cavity of a human auricle by adjustably engaging the tragus and antitragus of the human auricle, said means comprising said front outer portion and a movable member having an annular shape rotatably mounted on said annular outer casing, said movable member having a peripheral portion and a protruded portion protruding outwardly from said peripheral portion; and a cord supporting member on said outer casing supporting a connection cord extending from said electroacoustic element to the outside of said outer casing.

16. The earphone assembly of claim 15, wherein said front outer portion of said outer casing has a circular configuration and said engaging means comprises a second protruded portion that protrudes outwardly from said front outer portion.

17. The earphone assembly of claim 16, wherein said movable member and said protruded portion of said movable member are rotatable in a restricted angular pivotal range on said outer casing, said angular pivotal range including a position of said protruded portion of said movable member that is directly opposite to said second protruded portion of said outer casing.

18. The earphone assembly of claim 17, wherein said angular pivotal range of said protruded portion of said movable member is defined relative to a reference line extending through a center point of said annular outer casing and perpendicular to a longitudinal center line of said cord supporting member, said angular pivotal range extending from a point displaced about 15 degrees from said reference line toward said cord supporting member to a point displaced about 45 degrees from said reference line away from said cord supporting member.

19. The earphone assembly of claim 17, wherein said housing body comprises a peripheral flange portion having a pair of spaced stopper receiving edge walls defining a cut-off portion therebetween, and said movable member further comprises an inner surface having a stopper rib integrally formed therewith that protrudes inwardly from said inner surface into said cut-off portion, whereby said spaced stopper receiving edge walls define said restricted angular pivoted range.

20. The earphone assembly of claim 16, wherein said second protruded portion protrudes outwardly in a radial direction of said outer casing at a specified angle relative to a reference line of said housing body such that said engaging means functions to position said second protruded portion on a side of the auricle of the external auditory meatus when said outer casing is fitted in the cavity of the auricle.

* * * * *